US006428223B2

(12) United States Patent
Chen

(10) Patent No.: US 6,428,223 B2
(45) **Date of Patent: *Aug. 6, 2002**

(54) ASSEMBLING STRUCTURE FOR BRIDGE MEMBER AND FRAME PLATE OF PRESS KEY

(75) Inventor: Shih-Hsin Chen, Taichung (TW)

(73) Assignee: Sunrex Technology, Corp., Taichung (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/482,322

(22) Filed: Jan. 14, 2000

(51) Int. Cl.[7] ..... B41J 5/16
(52) U.S. Cl. ..... 400/495; 400/490
(58) Field of Search ..... 400/495, 492, 400/491.2, 491, 490, 472; 200/344, 345, 341

(56) References Cited

U.S. PATENT DOCUMENTS

| | | | | | |
|---|---|---|---|---|---|
| 5,630,501 | A | * | 5/1997 | Tsay | 200/341 |
| 5,898,145 | A | * | 4/1999 | Su | 200/341 |
| 5,964,341 | A | * | 10/1999 | Tsai | 200/344 |
| 5,997,196 | A | * | 12/1999 | Hu | 400/495 |
| 6,068,416 | A | * | 5/2000 | Kumanoto et al. | 400/495 |
| 6,072,134 | A | * | 6/2000 | Sato et al. | 200/344 |
| 6,091,036 | A | * | 6/2000 | Hu | 200/344 |

* cited by examiner

*Primary Examiner*—Andrew H. Hirshfeld
*Assistant Examiner*—Anthony H. Nguyen
(74) *Attorney, Agent, or Firm*—Bacon & Thomas

(57) ABSTRACT

Assembling structure for bridge member and frame plate of a press key, in which the cover block of the insertion slide section of the frame plate is formed with a guide section in contact with the outward extending slide posts of the bridge member. When the bridge member is connected with the frame plate, the slide posts of the bridge member are guided by the guide section to smoothly insert into the insertion slide section.

9 Claims, 4 Drawing Sheets

ASSEMBLING STRUCTURE FOR BRIDGE MEMBER AND FRAME PLATE OF PRESS KEY

BACKGROUND OF THE INVENTION

The present invention relates to an improved assembling structure for the bridge member and the frame plate of a press key in which the insertion contact face of the cover block of the insertion slide section of the frame plate is formed with a guide profile which enables the bridge member to be conveniently inserted with the frame plate.

The conventional computer keyboard is composed of multiple press keys, arranged in a certain pattern. Each press key is composed of a circuit board, a resilient member, a frame plate, a bridge member and a key cap which are sequentially upward disposed on the top face of the base board. One side of the frame plate is disposed with symmetrical pivot sections. The other side thereof is disposed with symmetrical insertion slide sections. The bottom face of the key cap is disposed with symmetrical pivot sections and guide sections. The bridge member is composed of two support frames. One side of one of the support frames is disposed with two inward extending pivot shafts for fitting into the pivot sections of the frame plate. The other side thereof is disposed with roll posts for sliding within the guide sections of the key cap. One side of the other support frame is disposed with cylindrical posts for pivotally rotatably fitted in the pivot sections of the key cap. The other side thereof is disposed with slide posts for slidably inserting into the insertion slide sections of the frame plate. The resilient member is fitted in a receiving space of the support frames. The circuit board is positioned between the resilient member and the baseboard to form a press key. The cover block of the insertion slide section of the frame plate is vertically formed in a sliding direction of the slide post and has a receiving space on only one single side. Therefore, when the slide posts of the support frames of the bridge member are inserted with the insertion slide section of the frame plate, the vertically formed insertion slide section is not designed with any guide section for the slide posts so that the end sections of the slide posts and the insertion slide sections often interfere with and obstacle each other prior to insertion. Generally, after the slide posts are forced and resiliently bent and deformed to a certain extent, the slide posts can be inserted into the slide space. Therefore, the bridge member can be hardly firmly mounted on the frame plate and even the slide posts or support frames may be permanently deformed due to improper pressing. This will seriously affect the procedure of processing and increase the ratio of defective products.

SUMMARY OF THE INVENTION

It is therefore a primary object of the present invention to provide an improved assembling structure -for the bridge member and the frame plate of a press key in which the insertion contact face of the top face of the cover block of the insertion slide section of the frame plate is formed with a guide profile ( which can be a cut, a reverse angle or an arch edge ), whereby when the bridge is inserted with the frame plate, the slide post of the support frame guided by the guide profile to smoothly and easily insert into the insertion slide section. Therefore, during the operation of insertion, the damage to the support frame is minimized.

It is a further object of the present invention to provide the above assembling structure for the bridge member and the frame plate of a press key, in which the frame plate is cut with an escape section at the insertion slide section corresponding to the insertion displacement position of the slide post of the support frame into the insertion slide profile, whereby when the slide post of the support frame is guided and displaced by the guide section of the cover block, there is sufficient space for the displacement and escape of the slide post so as to avoid interference and obstacle caused by the frame plate during insertion.

The present invention can be best understood through the following description and accompanying drawings wherein:

DETAILED DESCRIPTION OF THE PREFERRED EMBODIMENTS

Figure 1:
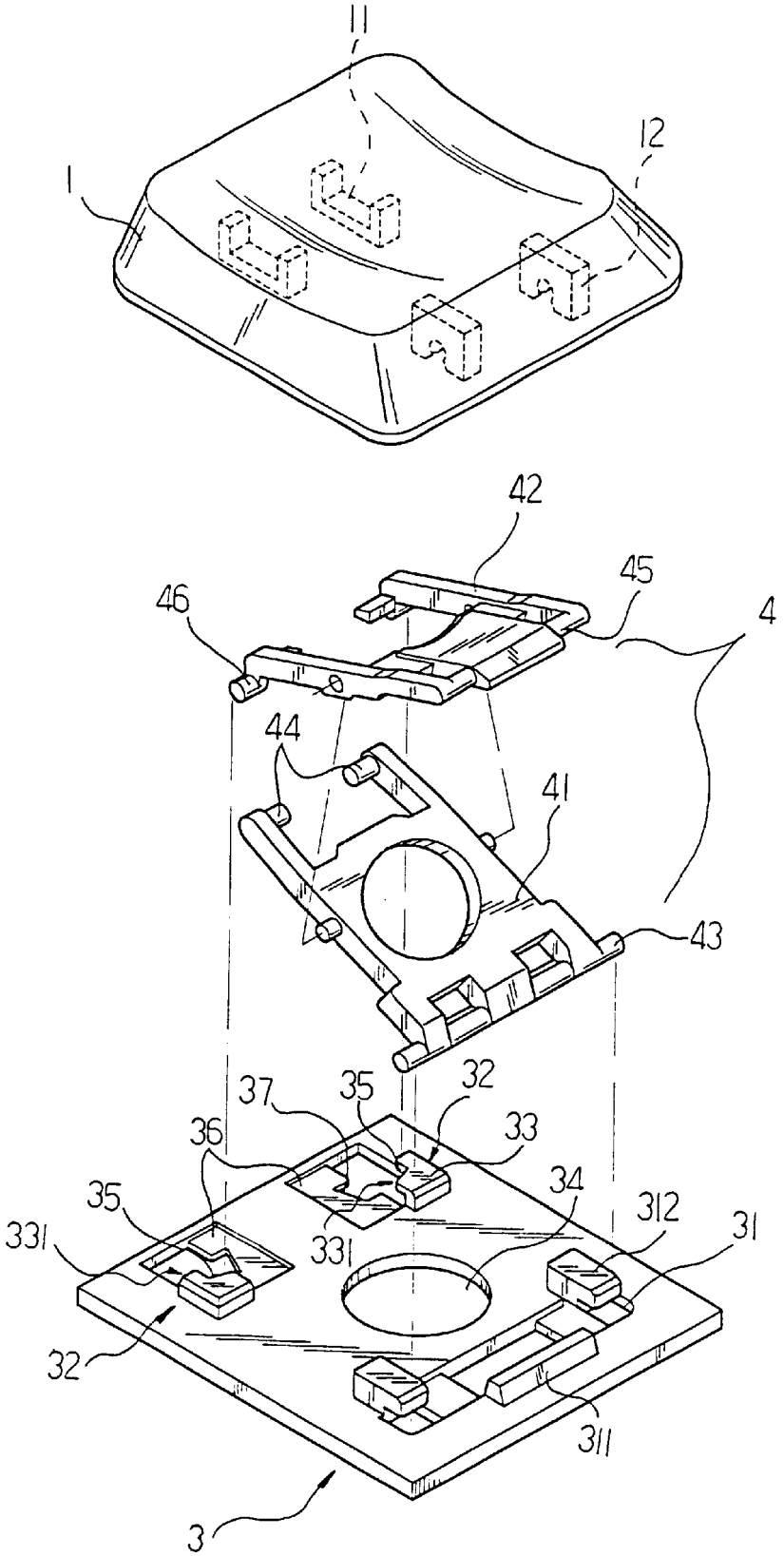
FIG. 1 is a perspective exploded view of the present invention.
Figure 2:
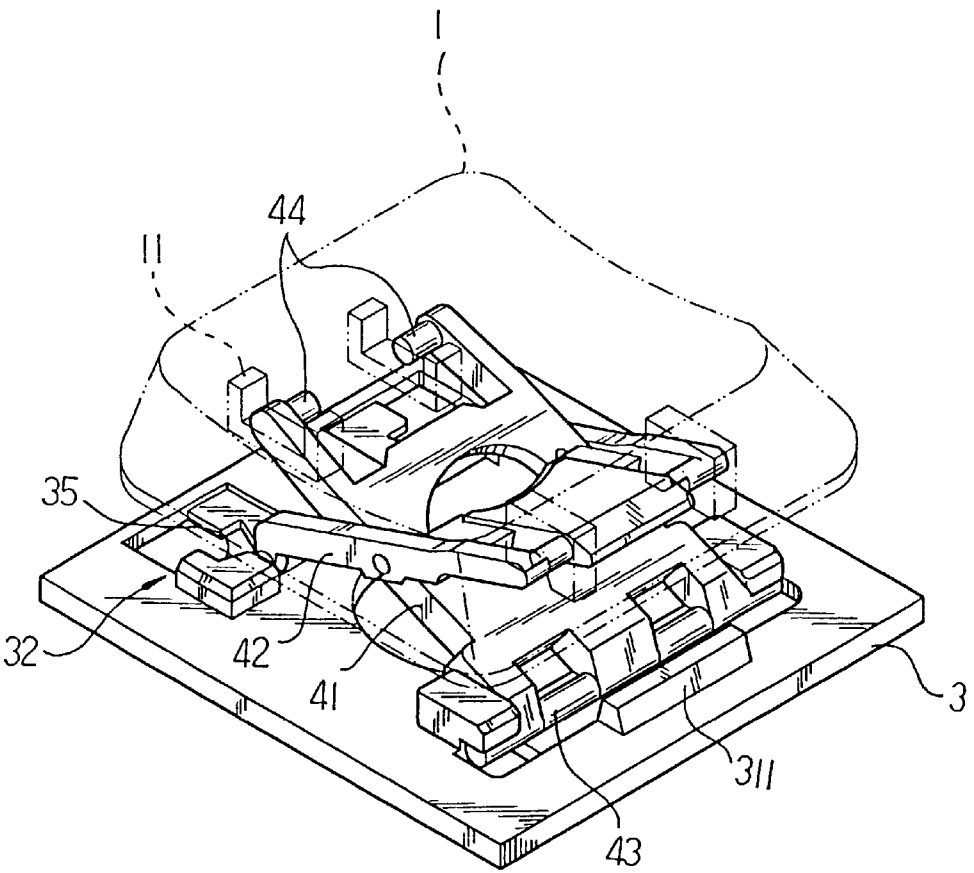
FIG. 2 is a perspective assembled view of the present invention.
Figure 3B:
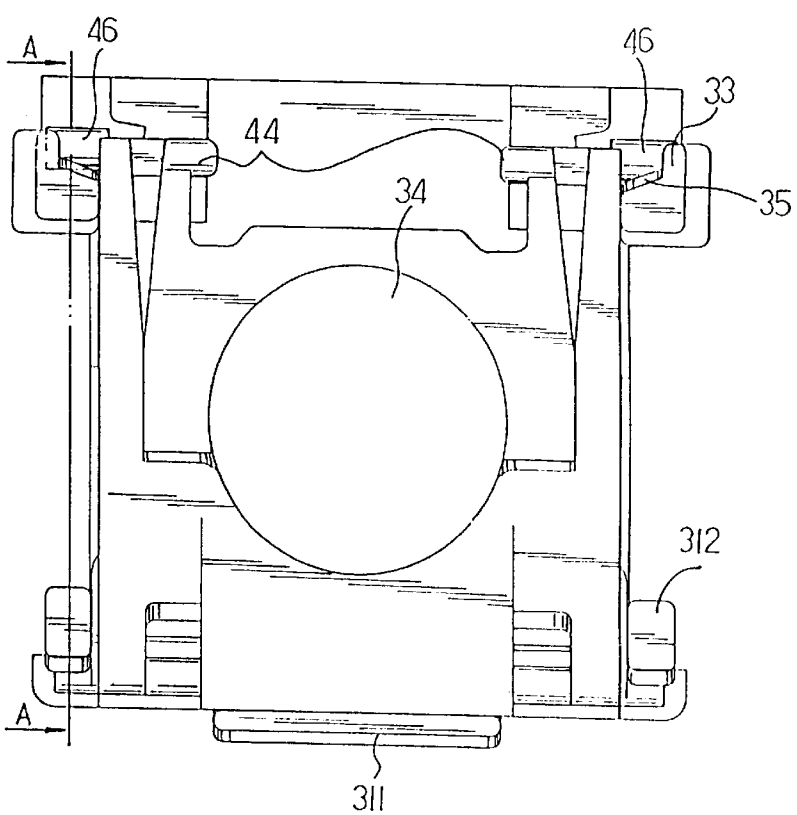
FIG. 3B is a plane view according to FIG. 3A, showing that the bridge member is connected with the frame plate of the present invention.
Figure 3A:
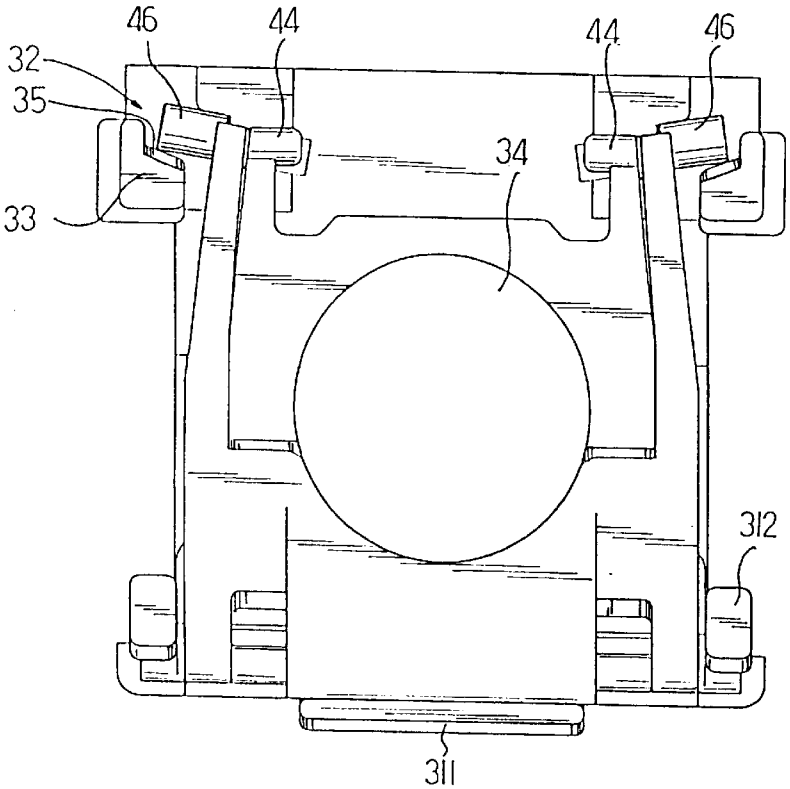
FIG. 3A is a plane view showing that the bridge member is being connected with the frame plate of the present invention.
Figure 4:
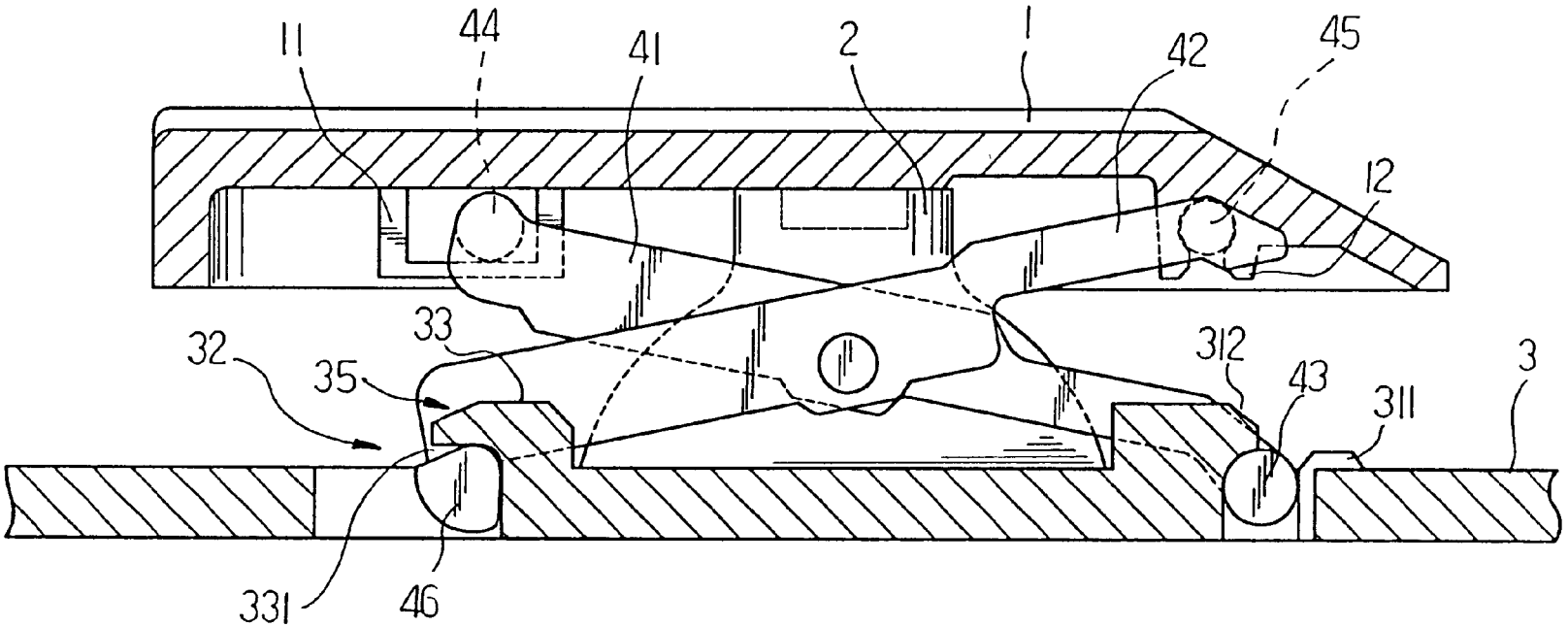
FIG. 4 is a sectional taken along line A—A of FIG. 3.

Please refer to FIGS. 1 and 2. The present invention is related to an assembling structure for the bridge member and the frame plate. The other components of the key, such as key cap 1, resilient member 2, etc. pertain to prior art and will not be described herein. The frame plate 3 is disposed with pivot sections 31 and insertion slide section 32. The pivot sections 31 are disposed at one end of a unit key section and each pivot section 31 is composed of a guide block 311 and a hook block 312. The insertion slide sections 32 are disposed at the other end of the unit key section, having an elevated cover block 33 defining an upper limit. The cover block 33 and the bottom face of the frame plate 3 define therebetween a horizontal slide channel 331. In addition, the frame plate 3 is formed with a through hole 34 for the resilient member 2 of the unit key to protrude therebeyond and abut against the key cap 1. The bridge member 4 is composed of two support frames 41, 42 which intersect and are pivotally connected with each other in an X-pattern. One end of one support frame 41 is disposed with two pivot shafts 43 for fitting into the pivot sect ions 31 of the frame plate 3. The other end thereof is disposed with two roll posts 44 for inserting into the guide sections 11. One end of the other support frame 42 is disposed with cylindrical posts 45 for pivotally rotatably fitted in the pivot sections 12 of the key cap 1. The other end is disposed with slide posts 46 for slidably inserting into the insertion slide sections 32 of the frame plate 3. The top face of the cover block 33 of the insertion slide section 32 of the frame plate 3 is formed with a guide profile 35(which can be a cut, an oblique guide angle, an arch angle, etc.) in contact with the slide posts 46 of the bridge member 4. When the bridge member 4 is connected with the frame plate 3, the outer contact edge of the slide post 46 of the support frame 42 is smoothly pushed and guided by the guide profile 35 of the cover block 33 so as to smoothly force the support frame 42 to resiliently displace in the pushing direction. Therefore, the operation of insertion into the insertion slide section 32 of the frame plate 3 can be smoothly performed. This eliminates the problem of interference or obstacle existing in the conventional structure.

In addition, the bottom face of the frame plate 3 is not only formed with a receiving recess 36 corresponding to the insertion slide section 32, but also inward cut with an escape section 37 corresponding to the insertion displacement position of the slide post 46 of the support frame 42, whereby when the slide post 46 of the support frame 42 is guided by the guide profile 35 of the cover block 33 and slowly smoothly downward inserted, a sufficient space is available to avoid interference of the slide post 46. Therefore, the insertion and installation can be more easily performed. This eliminates the interference and inconvenience and trouble in insertion of the conventional device so as to avoid damage of the support frame and slide post.

In practice, an obliquely cut guide edge or archly cut guide edge is rearward formed from the outer edge of the middle rear section of the cover block 33 toward the channel. The upper edge of the guide edge can be further disposed with guide angle edge so as to improve the insertion and sliding function.

In conclusion, the assembling structure of the bridge member and the frame plate of the present invention enables the bridge member and the frame plate to be easily and conveniently inserted with each other.

The above embodiments are only used to illustrate the present invention, not intended to limit the scope thereof. Many modifications of the above embodiments can be made without departing from the spirit of the present invention.

What is claimed is:

1. An assembly structure for a bridge member and frame plate of a press key for a computer key board, having a key cap supported on the frame plate by a bridge member in a X-pattern intersection, at least one support frame of the bridge member having a slide post for inserting into a corresponding insertion slide section contained in the frame plate, whereby the slide post slides within the insertion slide section, said assembly structure being characterized in that the insertion slide section formed in the frame plate contains a cover block, a lower side thereof containing a slide channel for the slide post to slidably insert therein, the end of the cover block containing a guide profile which includes a slide channel so as to smoothly guide the slide post of the support frame to expand the insertion slide section and smoothly insert into the slide channel.

2. An assembly structure for the bridge member and frame plate of a press key as claimed in claim 1, wherein the guide profile has an obliquely cut guide edge formed form the outer edge of the middle section of the cover block toward the channel.

3. An assembly structure for the bridge member and frame plate of a press key as claimed in claim 1, wherein the guide profile is an archly cut guide edge formed from the outer edge of a middle section of the cover block toward the channel.

4. An assembly structure for the bridge member and frame plate of a press key as claimed in claim 1, wherein the upper edge of the cover block is disposed with a guide angle edge.

5. An assembly structure for the bridge member and frame plate of a press key as claimed in claim 1, wherein the upper edge of the cover block is disposed with a guide angle edge.

6. An assembly structure for the bridge member and frame plate of a press key as claimed in claim 4, wherein the upper edge of the cover block is disposed with a guide angle edge.

7. An assembly structure for the bridge member and frame plate of a press key as claimed in claim 1, wherein the frame plate contains a cut with an escape section at the insertion slide section corresponding to the insertion displacement position of the slide post of the support frame into the insertion slide section so as to avoid interference during insertion.

8. An assembling structure for the bridge member and frame plate of a press key as claimed in claim 2, wherein the frame plate contains a cut with an escape section at the insertion slide section corresponding to the insertion displacement position of the slide post of the support frame into the insertion slide section so as to avoid interference and obstacle during insertion.

9. An assembling structure for the bridge member and frame plate of a press key as claimed in claim 4, wherein the frame plate is cut with an escape section at the insertion slide section corresponding to the insertion displacement position of the slide post of the support frame into the insertion slide section so as to avoid interference and obstacle during insertion.

* * * * *